US006322245B1

(12) United States Patent
Cooper

(10) Patent No.: US 6,322,245 B1
(45) Date of Patent: Nov. 27, 2001

(54) DOUBLE HEART WATCH

(76) Inventor: Douglas Cooper, 20 W. 64th St., Apt. 28V, New York, NY (US) 10023

( * ) Notice: Subject to any disclaimer, the term of this patent is extended or adjusted under 35 U.S.C. 154(b) by 0 days.

(21) Appl. No.: 09/532,394

(22) Filed: Mar. 22, 2000

Related U.S. Application Data

(60) Provisional application No. 60/125,770, filed on Mar. 23, 1999.

(51) Int. Cl.[7] ..... G04B 37/00; A44C 5/00

(52) U.S. Cl. ..... 368/276; 568/281

(58) Field of Search ..... 368/76, 88, 276, 368/281–282, 316–318; 224/164

(56) References Cited

U.S. PATENT DOCUMENTS 1,954,249 * 4/1934 Kehl .
1,980,207 * 1/1934 Kehl .
2,166,687 * 7/1939 Kehl .
2,801,779 * 8/1957 Jenkins .

* cited by examiner

*Primary Examiner*—Vit Miska
(74) *Attorney, Agent, or Firm*—Ostrolenk, Faber, Gerb & Soffen, LLP

(57) ABSTRACT

A complete watch comprised of two separate watch casings, each having its own watch band. The casings are interlocked by a pintle along one abuttable face of the first watch casing received in a correspondingly shaped groove in the abuttable face edge of the second casing.

4 Claims, 2 Drawing Sheets

DOUBLE HEART WATCH

This application claims benefit of provisional application Ser. No. 60/125,170 filed Nov. 23, 1999.

FIELD OF THE INVENTION

The present invention generally relates to watches and more particularly to a watch design consisting of two separate watch faces and bands that may be joined.

BACKGROUND OF THE INVENTION

A typical watch is comprised of a single watch face and a single band for attaching the watch to the wrist. It is worn by one person. But persons who want to share their affection may want to share jewelry, like a watch. That was usually not possible, until the present invention.

SUMMARY OF THE INVENTION

An object of the invention is to provide a watch that is selectively an attractive single watch to be worn on one wrist or a watch that can be simultaneously worn by two persons, on two wrists.

In the present invention, two completely separate watches on two separate respective watch bands are selectively worn separately or joined together to be worn as one unit.

A preferred embodiment of the present invention provides two watches, each in its own casing connected to its own wrist band. The casings are designed to be attractive when the watches are worn separately. The casings have a respective connector along one side so that they can be joined together to form one watch casing. The separate casings are shaped so that when they are together, they provide a complete attractive watch with an apparently single casing.

A preferred form of a combined casing is a heart shape, and each half of the heart is a complete separate casing with its own watch and band.

BRIEF DESCRIPTION OF THE DRAWINGS

For the purposes of illustrating the present invention, there is shown in the drawings a form which is presently preferred, it being understood however, that the invention is not limited to the precise form shown.

DETAILED DESCRIPTION OF THE INVENTION

Figure 1:
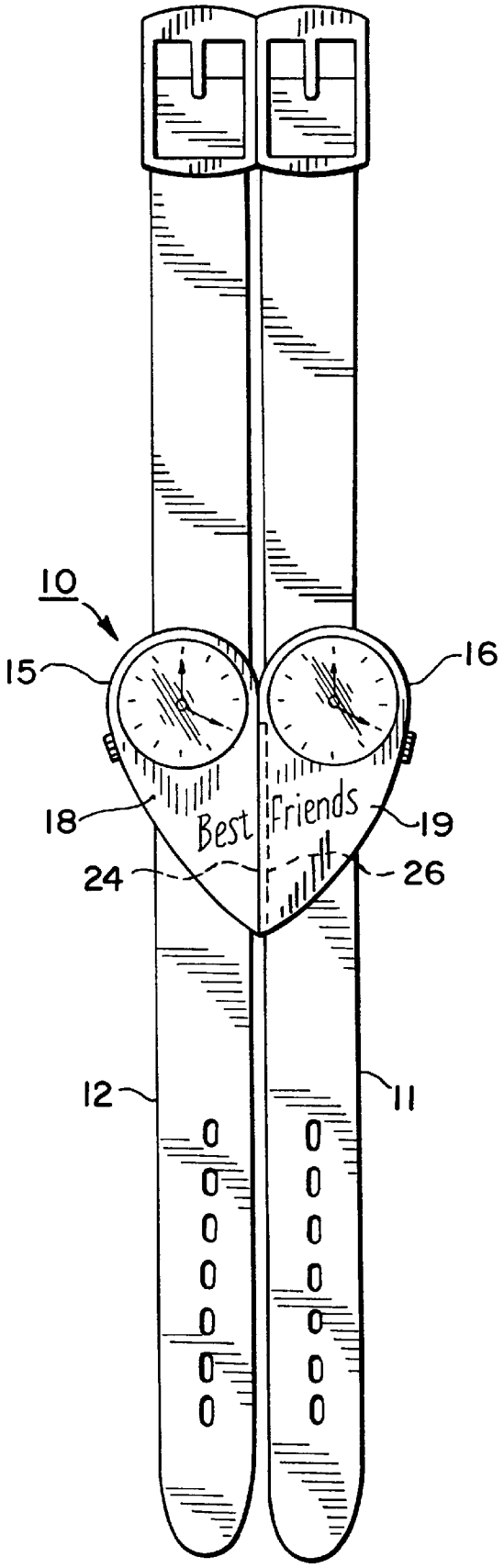
FIG. 1 is a front view of a combined assembled watch according to the present invention.
Figure 2:
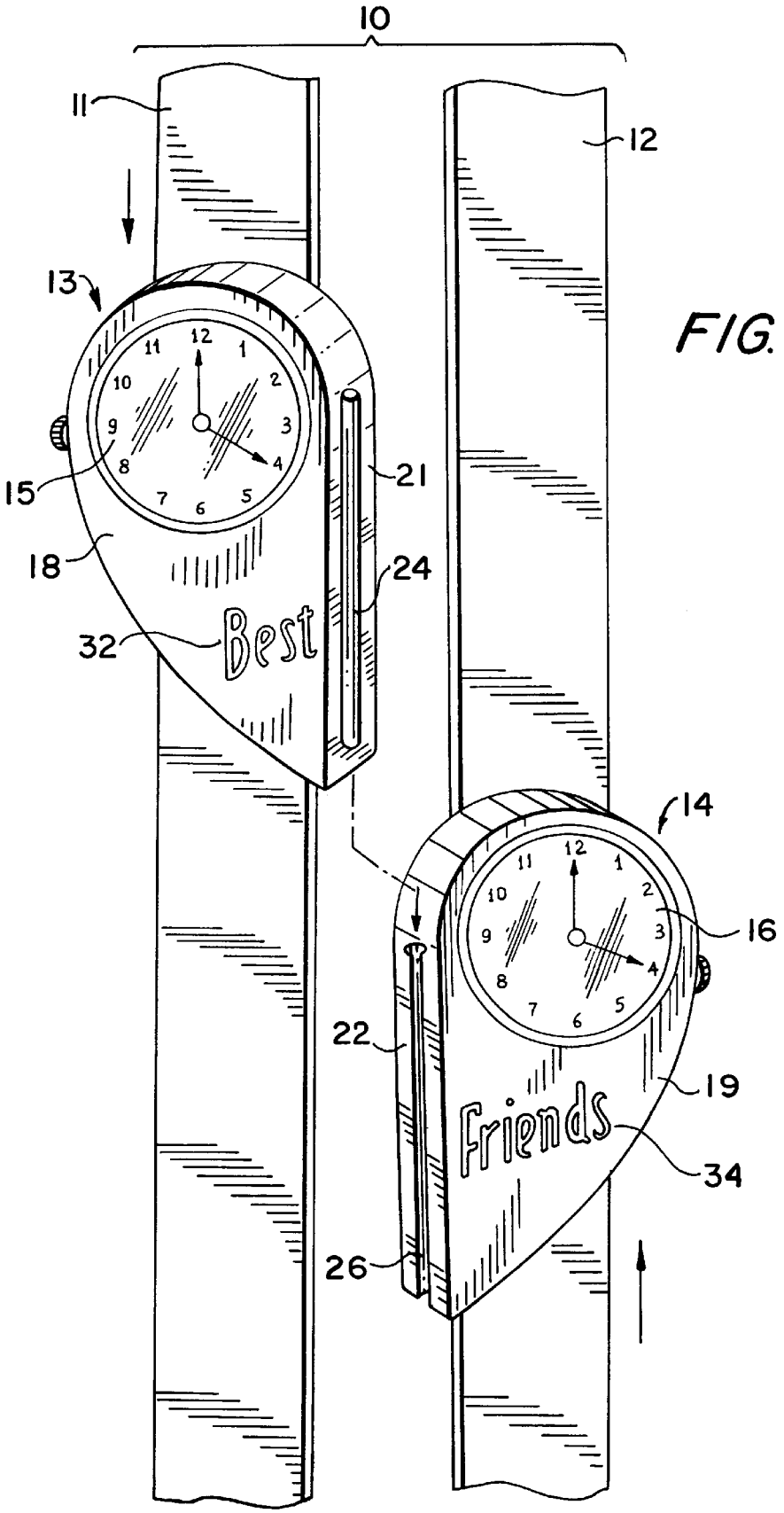
FIG. 2 is an enlarged front view of the watch in FIG. 1 disassembled into its two complete component watches and illustrating how its parts may be assembled.

FIG. 1 shows a complete watch comprising two separable watch casings 15 and 16, and respective watch securement devices to hold each watch casing on a person, particularly bands 11 and 12 each for its casing. Other securements might include a pin for clothing or a necklace. FIG. 1 shows the two casings joined together into one combined watch 10, while FIG. 2 shows them apart. When joined, the watch faces form a unitary ornamental heart shape piece 10.

FIG. 2 shows the watch 10 in FIG. 1 separated into two separate completely independent watches 13 and 14. Each watch includes a complete casing and an entire independent watch mechanism and face 15 and 16. Each watch can be worn by a person. When the watches are assembled together, both can be worn together as a single complete watch. The separable and joinable heart shaped casing illustrated is particularly attractive for this type of watch 10.

FIG. 2 also shows an easy mode of attaching the separated watches 13 and 14. The casings 18 and 19 of the watches 15 and 16 have respective abuttable faces 21 and 22 which form a unitary, unbending watch casing when those faces are brought firmly together. Face 21 has a rib or pintle 24 extending along the face and projecting out from the face 21. opposing face 22 has a complementary shape and length groove 26 formed in it. When the pintle 24 is slid into and through the groove 26 from an end of each of them, faces 21 and 22 are firmly abutted and the casings are held together forming the combined single casing with two watch bands providing the heart shape watch 10 in FIG. 1.

The front of each casing 18 and 19 may carry a respective design or written legend 32 and 34, which is a complete design or legend only when the watch casings are assembled.

Although the present invention has been described in relation to a particular embodiment thereof, many other variations and to other uses will be apparent to those skilled in the art. It is preferred, therefore, that the present invention be limited not by the specific disclosure herein, but only by the accompanying claims. t,1070

What is claimed is:

1. A watch comprising:

a first and a second watch casing;

a respective complete watch in each casing;

the first and second casings respectively having a first and a second opposing and abuttable side, and the casings being assembleable with their abuttable sides abutting to define a complete watch casing comprising the first and second casings;

a respective watch securement device on each casing;

an interlock mechanism on the first and second abuttable sides operable for assembling the first and second casings together and permitting their disassembly.

2. The watch of claim 1, wherein the interlock mechanism comprises a pintle along the first abuttable side of the first casing and a correspondingly shaped groove in and along the second abuttable side of the second watch casing, the pintle being removably received in the groove for assembling the first and second casings.

3. The watch of claim 1, wherein the securement device on each casing comprises a watch band.

4. The watch of claim 1, wherein the complete watch casing has a heart shape and the first and second casings each comprise a respective part of the heart shape.

* * * * *